US009880511B2

(12) United States Patent
Takahashi

(10) Patent No.: US 9,880,511 B2
(45) Date of Patent: Jan. 30, 2018

(54) CONTAINER FOR WASTE DEVELOPER AND IMAGE FORMING APPARATUS

(71) Applicant: CANON KABUSHIKI KAISHA, Tokyo (JP)

(72) Inventor: Hiroyuki Takahashi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/210,856

(22) Filed: Mar. 14, 2014

(65) Prior Publication Data

US 2014/0270821 A1 Sep. 18, 2014

(30) Foreign Application Priority Data

Mar. 15, 2013 (JP) ..... 2013-054386

(51) Int. Cl.
*G03G 21/10* (2006.01)
*G03G 21/12* (2006.01)

(52) U.S. Cl.
CPC ..... *G03G 21/105* (2013.01); *G03G 21/12* (2013.01); *G03G 21/10* (2013.01)

(58) Field of Classification Search
CPC ..... G03G 21/105; G03G 21/12; G03G 21/10
USPC ..... 399/35
See application file for complete search history.

(56) References Cited

U.S. PATENT DOCUMENTS 6,697,167 B1 2/2004 Takahashi
6,771,920 B2 8/2004 Abe et al.
2004/0052560 A1 3/2004 Ishii et al.
2005/0036810 A1* 2/2005 Murakami ..... G03G 21/12 399/360
2005/0220515 A1* 10/2005 Wakana ..... G03G 21/12 399/358
2009/0263147 A1* 10/2009 Kumagai ..... 399/35
2010/0021212 A1* 1/2010 Sumii ..... G03G 15/0844 399/262
2011/0091227 A1* 4/2011 Tomita et al. ..... 399/35
2012/0128391 A1* 5/2012 Ushikubo ..... G03G 21/12 399/262

(Continued)

FOREIGN PATENT DOCUMENTS

JP H05-204281 A 8/1993
JP H10-288931 A 10/1998
JP 2002-148884 A 5/2002

(Continued)

OTHER PUBLICATIONS

Office Action in Japanese Patent Application No. 2013-054386, dated Dec. 20, 2016.

*Primary Examiner* — Erika J Villaluna
(74) *Attorney, Agent, or Firm* — Fitzpatrick, Cella, Harper & Scinto

(57) ABSTRACT

A container for accommodating a developer collected from an image forming apparatus includes a container body for accommodating the collected developer; a closing member, dividingly separable from the container body, for closing the container body; a rotatable feeding member for feeding the developer accommodated in the container body; and a holding portion, provided on the closing member, for holding the feeding member so that when the closing member and the container body are dividingly separated, the closing member and the feeding member are integrally separable from the container body.

17 Claims, 10 Drawing Sheets

(56) References Cited

U.S. PATENT DOCUMENTS

| | | | | |
|---|---|---|---|---|
| 2012/0251210 | A1* | 10/2012 | Itagaki | 399/358 |
| 2013/0164063 | A1 | 6/2013 | Konishi | |

FOREIGN PATENT DOCUMENTS

| | | | |
|---|---|---|---|
| JP | 2004-045451 | A | 2/2004 |
| JP | 2004-102137 | A | 4/2004 |
| JP | 2009-27663 | A | 11/2009 |
| JP | 2010-026441 | A | 2/2010 |
| JP | 2013-130786 | A | 7/2013 |

* cited by examiner

CONTAINER FOR WASTE DEVELOPER AND IMAGE FORMING APPARATUS

FIELD OF THE INVENTION AND RELATED ART

The present invention relates to a container for waste developer, more specifically, the developer having been removed from the photosensitive drum, intermediary transfer member, etc., of an electrophotographic image forming apparatus, and the like. It relates also to an image forming apparatus equipped with a container for waste developer.

It is a common practice, in the field of an electrophotographic image forming apparatus, for example, to remove the toner remaining on the peripheral surface of an electrophotographic photosensitive member (photosensitive member, hereafter) after the transfer of a toner image formed on the photosensitive member, and collect the removed developer (waste developer) into a container (box for waste toner) for waste developer. It is also common practice to collect into a box for waste toner, the toner removed from the intermediary transfer member, onto which a toner image, which is to be transferred onto a sheet of transfer medium, is temporarily transferred, and also, the toner removed from the transfer medium bearing member, by which a sheet of transfer medium, onto which a toner image is transferred from a photosensitive drum. As a box for waste toner is filled up with waste toner, it needs to be replaced or cleaned.

In order to reduce an image forming apparatus in the space which the main assembly of the image forming apparatus occupies, and also, to improve a box for waste toner in fill-ratio, some boxes for waste toner (which hereafter may be referred to simply as toner collection box) are provided with toner conveying members for evenly distributing waste toner in a toner collection box (Japanese Laid-open Patent Application 2002-148884, Japanese Laid-open Patent Application 2009-276631).

A toner collection box such as the one described above is roughly in the form of a long and narrow rectangular parallelepiped. It has: a main portion which holds waste toner in its internal space; and a lid which keeps the main portion sealed from above; and a conveying member (conveying members). The conveying member is positioned so that it extends along the highest level to which the body of toner in the main portion is allowed to reach before the toner collection box needs to be replaced or cleaned. The toner collection box is structured so that as waste toner is dropped into the main portion of the box, it is distributed by the conveying member(s) in the direction parallel to the long edges, as well as the short edges, of the main portion. Conventionally, a toner collection box is structured so that the conveying member(s) is supported by the main or bottom portion of the toner collection box, and the top lid simply sandwiches the conveying member(s) between itself and the main portion.

Some toner collection boxes are structured so that they can be reused. That is, they are brought back to a collection box service station, in which they are subjected to a process of disassembling the collection box, a process of discarding the waste toner, a process of cleaning the main portion, and a process of reassembly the collection box, to be reused. This is for reducing a toner collection box (i.e., image forming apparatus) in the cost of replacement parts, or the like purposes. Further, in recent years, an image forming apparatus has come to be required to be very significantly reduced in operational cost. Thus, it is required to be reduced in the cost of replacement parts, and also, to be increased in the durability of its maintenance related components. Thus, a toner collection box has been significantly increased in capacity.

However, it takes a substantial length of time to bring a toner collection box to a service station to disassemble, clean, and reassemble the toner collection box in order to reuse the toner collection box.

In comparison, in a case where a toner collection box is disassembled and reassembled at a place of its usage, it is necessary for the section of the collection box, which is for detecting whether or not the toner collection box is full, to be replaced or cleaned. Further, as a toner collection box is significantly increased in capacity, it increases in the length of time necessary to remove the toner collection box from an image forming apparatus.

In some cases, therefore, a toner collection box is simply discarded after being removed from an image forming apparatus to remove the waste toner from the image forming apparatus. In other words, not only is the main portion of the toner collection box discarded, but also, the top lid, and the conveying member(s), which are rather high in replacement cost and are recyclable, are discarded. This is one of the reasons why it is difficult to reduce a toner collection box (image forming apparatus) in operational cost.

SUMMARY OF THE INVENTION

Thus, the primary object of the present invention is to provide a toner (developer) collection container, which is significantly less in the length of time, and amount of labor, which are required to replace a developer collection container, and is significantly less in the number of replacement parts, and cost of replacement parts, and an image forming apparatus equipped with the toner (developer) collection container.

According to an aspect of the present invention, there is provided a container for accommodating a developer collected from an image forming apparatus includes a container body for accommodating the collected developer; a closing member, dividingly separable from the container body, for closing said container body; a rotatable feeding member for feeding the developer accommodated in said container body; and a holding portion, provided on said closing member, for holding said feeding member so that when said closing member and said container body are dividingly separated, said closing member and said feeding member are integrally separable from said container body.

According to another aspect of the present invention, there is provided an image forming apparatus comprising such a container.

Further features of the present invention will become apparent from the following description of exemplary embodiments (with reference to the attached drawings).

DESCRIPTION OF THE PREFERRED EMBODIMENTS

Hereinafter, the developer collection containers and image forming apparatuses in accordance with the present invention are described in detail with reference to the appended drawings.

Embodiment 1

1. Image Forming Apparatus

First, an image forming apparatus equipped with the developer collection container in accordance with the present invention is described about its overall structure.

Figure 1:
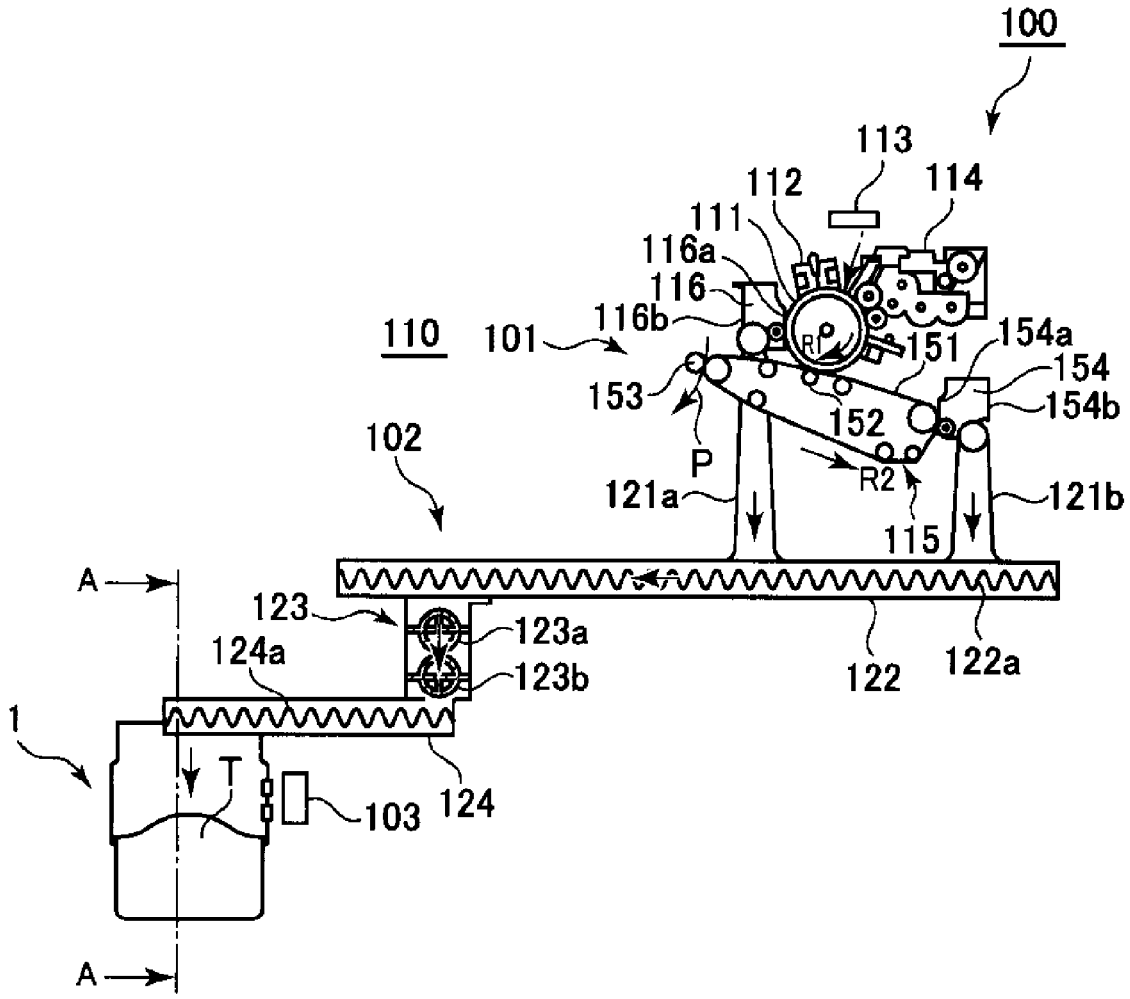
FIG. 1 is a schematic sectional view of a typical image forming apparatus equipped with the toner collection box in the first embodiment of the present invention.

FIG. 1 is a schematic sectional view of the image forming apparatus 100 in this embodiment. It shows the overall structure of the image forming apparatus 100. The image forming apparatus 100 in this embodiment is a printer which uses an electrophotographic image forming method, and employs an intermediary transferring means. The developer collection container in this embodiment stores residual waste toner (transfer residual toner), that is, the toner (developer) collected from the photosensitive drum and intermediary transfer member of the image forming apparatus after the transfer of a toner image therefrom.

Regarding the direction of the image forming apparatus 100 and its components, the front side (front surface) is the normal side of the apparatus, from which an operator operates the apparatus, and the front side (front surface) is the opposite side of the image forming apparatus 100 from the front side. In the case of the image forming apparatus 100 in this embodiment, the direction (which hereafter will be referred to as "depth direction") parallel to the line which connects the front and rear sides is roughly parallel to the rotational axis of the photosensitive member (which will be described later). The front side corresponds to the surface of the sheet of paper, on which FIG. 1 is, and the rear side corresponds to the rear surface of the sheet of paper on which FIG. 1 is. Also regarding the direction of the image forming apparatus 100 and its components, "upward" and "downward" mean the upward and downward directions, respectively, in terms of the direction of gravity, when the image forming apparatus 100 is in the normal attitude in which it is usable.

The main assembly 110 of the image forming apparatus 100 contains: a printing portion 101 as an image forming means; a toner conveying device (as developer conveying means) for conveying waste toner (waste developer); a box for waste toner (container for waste developer) in which waste toner is stored; etc.

The printing portion 101 has a rotatable photosensitive member (photosensitive drum) 111, which is the image bearing first member. The photosensitive member 111 is rotationally driven in the direction indicated by an arrow mark R1 in FIG. 1. The printing portion 101 has also a charging device 112 as a charging means, an exposing device (laser scanner) 113 as an exposing means (image writing means), a developing device 114 as a developing means, a transferring device 115, and a photosensitive member cleaner 116 as a photosensitive member cleaning device, which are disposed in the adjacencies of the peripheral surface of the photosensitive member 111, in the listed order in terms of the rotational direction of the photosensitive member 111.

The transferring device 115 has an intermediary transferring member (intermediary transfer belt) 151, which is the image bearing second member and is in the form of an endless belt. The intermediary transferring member 151 is suspended by multiple rollers (as belt supporting members) in such a manner that it is provided with a preset amount of tension. It is circularly driven in the direction indicated by an arrow mark R2 in FIG. 1. The transferring device 115 has also a primary transfer roller (as primary transferring means) 152, which is the primary transferring member. The primary transfer roller 152 is on the inward side of the loop which the intermediary transferring member 151 forms. It forms the primary transfer station N1, in which the photosensitive member 111 and intermediary transferring member 151 contact each other. Further, the transferring device 115 has also a secondary transfer roller 153 as the secondary transferring member, which is in the form of a roller. The secondary transfer roller 153 is on the outward side of the loop which the intermediary transferring member 151 forms. It opposes one of the abovementioned multiple rollers by which the intermediary transferring member 151 is suspended. The secondary transfer roller 153 forms the secondary transfer station N2 by being placed in contact with the intermediary transferring member 151. Further, the transferring device 115 has an intermediary transferring member cleaner 154 (as means for cleaning intermediary transferring member), which is on the outward side of the loop which the intermediary transferring member 151 forms, and opposes one of the abovementioned rollers by which the intermediary transferring member 151 is suspended.

Further, the image forming apparatus 100 has a transfer medium feeding device (unshown), a fixing device (unshown), etc. The transfer medium feeding device stores multiple sheets P of transfer medium, such as paper, and supplies one by one the sheets P of transfer medium to the secondary transfer station N2 with a preset timing. The fixing device fixes an unfixed toner image to the sheet P of transfer medium after the transfer of the toner image to the sheet P.

As an image forming operation is started, the photosensitive member 111 is rotationally driven in the direction indicated by the arrow mark R1 at a preset peripheral velocity. As the photosensitive member 111 is rotated, its peripheral surface is roughly uniformly charged to preset polarity and potential level by the charging device 112. Then, the charged portion of the peripheral surface of the photosensitive member 111 is scanned by (exposed to) the beam of laser light emitted by the exposing device 113 while being modulated according to the information of the image to be formed, whereby an electrostatic latent image, which is in accordance with the information of the image to be formed, is formed. Then, the electrostatic latent image on the peripheral surface of the photosensitive member 111 is developed by the developing device 114 which uses toner (as developer), into a visible image, that is, an image formed of toner. That as, a toner image is formed on the peripheral surface of the photosensitive member 111. Then, the toner image on the photosensitive member 111 is transferred (primary transfer) onto the intermediary transferring member 151 by the function of the primary transfer roller 152, in the primary transfer station N1. Then, the toner image on the intermediary transferring member 151 is transferred (secondary transfer) onto a sheet P of transfer medium conveyed to the secondary transfer station N2. Then, the sheet P of transfer medium, onto which the toner image has just been transferred, is conveyed to the fixing device, in which the sheet P and the toner image thereon are subjected to heat and pressure. Consequently, the toner image becomes fixed to the sheet P. Then, the sheet P is discharged from the image forming apparatus 100.

On the other hand, the toner (primary transfer residual toner) remaining on the peripheral surface of the photosensitive member 111 after the primary transfer is removed from the peripheral surface of the photosensitive member 111 by the photosensitive member cleaner 116, which removes the primary transfer residual toner by scraping the peripheral surface of the rotating photosensitive member 111, with its cleaning member 116*a*, such as a cleaning blade, and collects the removed primary transfer residual toner, into a toner collecting portion 116*b*. As the primary transfer residual toner is collected into the collection toner collecting portion 116*b*, it is pushed out of the toner collecting portion 116*b*, into the first chute 121*a* of the toner conveying device 102, or is conveyed by the conveying member. As for the toner (secondary transfer residual toner) remaining the surface of the intermediary transferring member 151 after the secondary transfer, it is removed from the intermediary transferring member 151 by the intermediary transferring member clearer 154, which removes the secondary transfer residual toner from the surface of the circularly moving intermediary transferring member 151, by scraping the surface of the intermediary transferring member 151 with its cleaning member 154, such as a cleaning blade, and collects the waste toner into the collection toner collecting portion 154*b*. Then, the waste toner in the waste toner collecting portion 154*b* is pushed out of the portion 154*b*, into the second chute 121*b* of the toner conveying device 102, which will be described later, or conveyed by the conveying member.

As described above, the transfer residual toner, that is, the toner which remains on the photosensitive member 111 and intermediary transferring member 151 after the primary and secondary transfers, is collected by the photosensitive member cleaner 1, and intermediary transferring member cleaner 12, respectively. Then, the collected transfer residual toner is conveyed to the transfer residual toner box 1, by the toner conveying device 102.

The toner conveying device 102 has the first and second chutes 121*a* and 121*b*, an upstream pipe 122, a buffer portion 123, a downstream pipe 124, etc. The first chute 121*a* is in connection to the photosensitive member cleaner 116. As the collected transfer residual toner is discharged from the photosensitive member cleaner 116 into the first chute 121*a*, and falls through the first chute 121*a*. The second chute 121*b* is in connection to the intermediary transferring member cleaner 154. As the collected transfer residual toner is discharged from the intermediary transferring member cleaner 154 into the second chute 121*b*, it falls through the second chute 1211*b*. The upstream pipe 122 is in connection to the first and second chutes 121*a* and 121*b*. It conveys the collected residual toner discharged into it, from the first and second chutes 121*a* and 121*b*. There is a rotatable screw 122*a* (as conveying means) in the upstream pipe 122. The buffer portion 123 is in connection to the upstream pipe 122. It temporarily stores the collected residual toner as the collected residual toner is conveyed to the buffer portion 123 through the upstream pipe 122. There are rotatable stirring blades 123*a* and 123*b* (as stirring-conveying means) which conveys the collected residual toner in the buffer portion 123. The downstream pipe 124 is in connection to the buffer portion 123, by one of its lengthwise ends. The other lengthwise end of the downstream pipe 124 is in connection with the box 1 for the collected residual toner, in such a manner that it can be disconnected from the box 1. There are rotatable screws 124*a* (as conveying means) in the downstream pipe 124.

2. Toner Box for Collected Residual Toner

Next, the toner box 1 for the collected residual toner in this embodiment is described.

Figure 2:
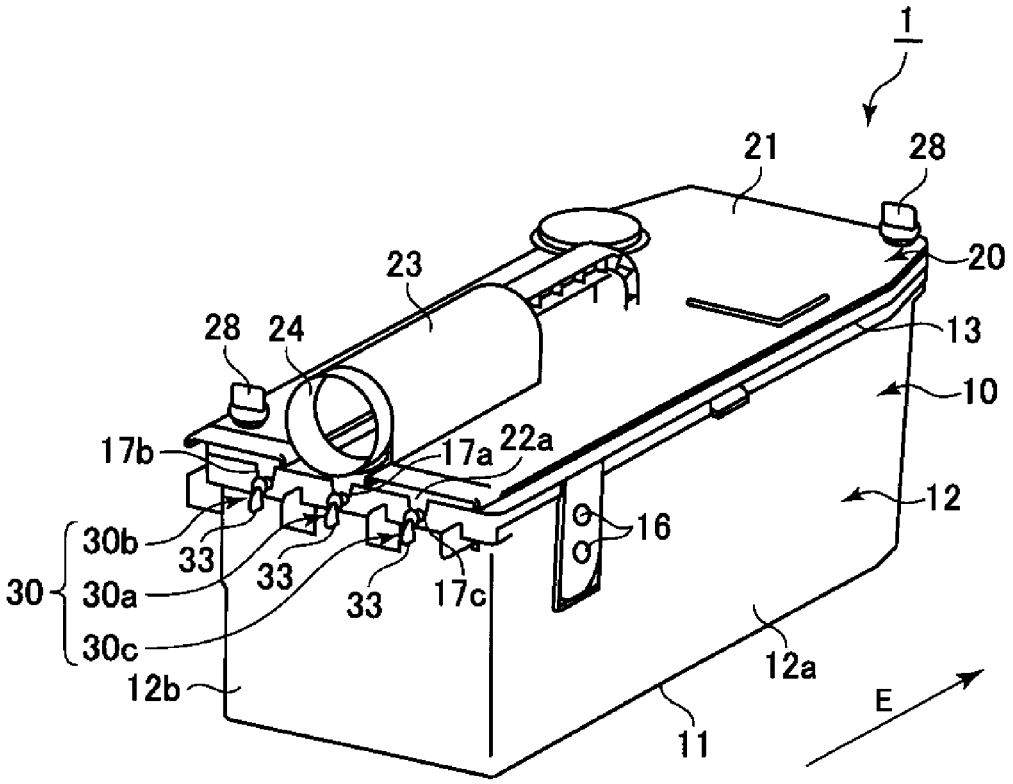
FIG. 2 is a schematic perspective view of the toner collection box in the first embodiment.
Figure 3:
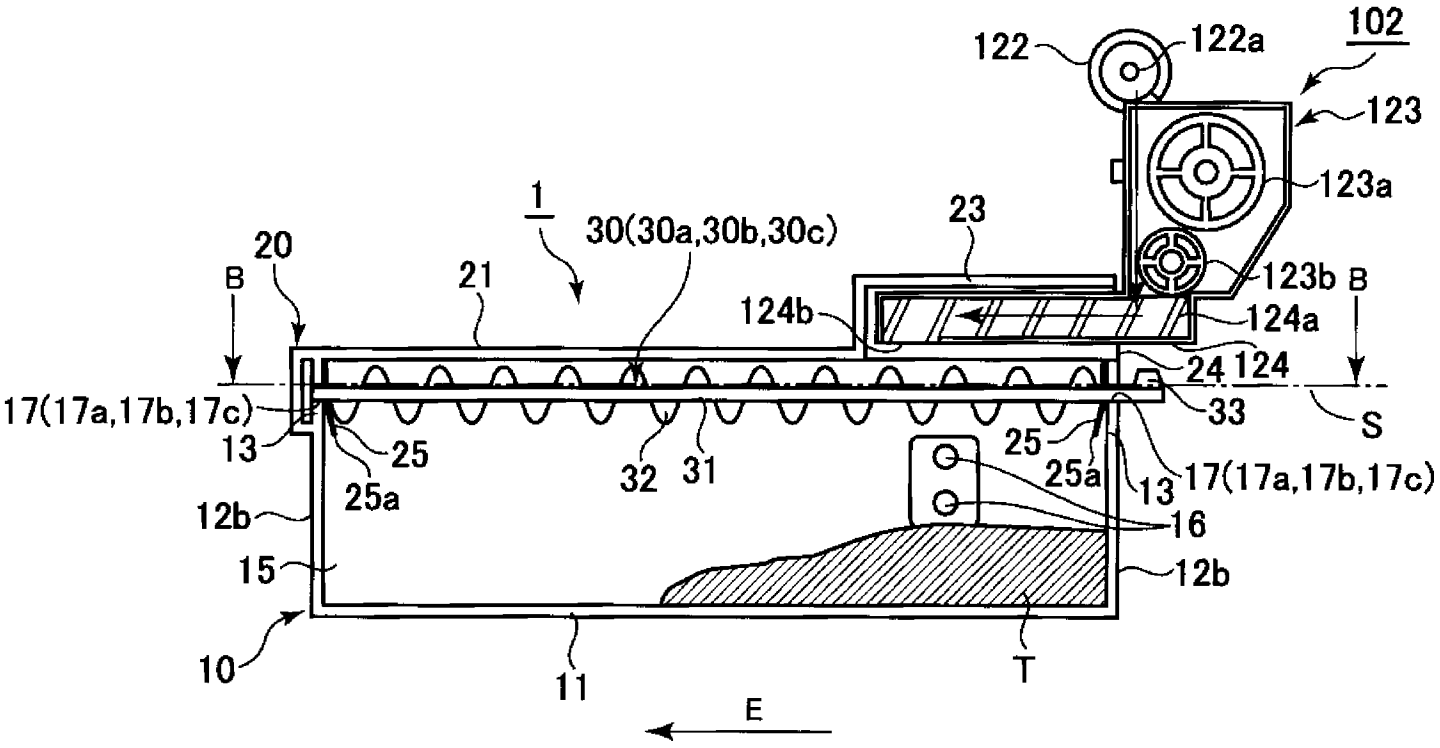
FIG. 3 is a schematic sectional view of the toner collection box in the first embodiment.

FIG. 2 is a perspective view of the toner box 1 for the collected residual toner (which hereafter will be referred to as toner collection box 1) in this embodiment, as seen from diagonally above the left rear corner of the box 1. FIG. 3 is a sectional view the toner collection box 1 and a part of the toner conveying device 102, at a plane A-A in FIG. 1.

In this embodiment, the toner collection box 1, as a container for the collected residual developer, stores the toner T (developer) collected in the image forming apparatus 100 by photosensitive member cleaner 116 and intermediary transferring member cleaner 154 and delivered to the toner collection box 1 from the photosensitive member cleaner 116 and intermediary transferring member cleaner 154. The toner collection box 1 has the main portion 10, or the portion which holds the toner, and a lid 20 which can be removably attached to the main portion 10 to keep the main portion 10 sealed. Further, this toner collection box 1 has toner conveying screws 30 (30*a*, 30*b* and 30*c*), as rotatable conveying members, which are for conveying the collected transfer residual toner in the main portion 10. It has also a pair of holding plates 25 having holding grooves 26. The holding plate 25 is a part of the lid 20, and is for holding the conveying screws 30. In this embodiment, the toner collection box 1 is structured so that as the lid 20 is removed from the main portion 10, the toner conveying screws 30 (30*a*, 30*b* and 30*c*) remain with the lid 20; the toner conveying screws 30 are removable from the main portion 10. That is, the toner collection bow 1 is structured so that when the lid 20 is removed from the main portion 10, the toner conveying screws 30 (30*a*, 30*b* and 30*c*) are removed from the main portion 10 together with the lid 20. Next, this structural arrangement is described in detail.

In terms of overall shape, the toner collection box 1 is in the form of a long and narrow rectangular parallelepiped, the lengthwise direction of which coincides with the depth direction (front-rear direction) of the image forming apparatus 100. It has the main portion 10 which is for holding the waste toner T, and the lid 20 for keeping sealed the top opening 14 (FIG. 4A) of the main portion 10, and is structured so that the lid 10 is vertically separable upward from the main portion 10.

The main portion 10 has: a long and narrow bottom wall 11, the lengthwise edges of which are parallel to the depth direction of the image forming apparatus 100; four lateral walls 12 which perpendicularly extend upward from the four edges of the bottom wall 11, one for one, in a manner of surrounding the bottom wall 11; and flanges 13, which are at the top edges of the lateral walls 12, and surround the top opening 14 (FIG. 4A) of the main portion 10. It is in the internal space 15 (storage for collected residual toner) of the main portion 10 that the waste toner T is stored. Also in this embodiment, the main portion 10 is provided with a detection window 16, as a detecting portion, through which an operator can find out whether or not the main portion 10 has become full, more specifically, the amount of the waste toner T in the toner collection box 1 has reached a preset valve. It is one of the lateral walls 12*a*, the long edges of which are parallel to the lengthwise direction of the main portion 10, that is provided with the detection window 16. To describe in greater detail, in terms of the lengthwise direction of the lateral wall 12*a*, the detection window 16 is on the rear side of the center of the wall 12*a*. In terms of the vertical direction, it is positioned at the right height for allowing the operator (observer) to correctly detect whether or not the toner collection box 1 is full. That the toner collection box 1 is full means that the amount of the waste toner T in the toner collection box 1 has increased so much that the top of the body of the waste toner has reached a level preset for maintenance such as replacement or cleaning of at least a part of the toner collection box 1.

Further, the main assembly 110 of the image forming apparatus 100 in this embodiment is provided with an optical sensor 103 of the reflection or transmission type, or a sensor of the permeability detection type, (which hereafter may be referred to simply as sensor; FIG. 1), as detecting means, which detects toner density/residual amount in the toner collection box 1 to determine whether or not the toner collection box is full. The image forming apparatus 100 is structured so that the sensor 103 detects the toner in the toner collection box 1 through the detection window 16, and outputs toner detection (absence) signals, which are inputted into the control section (unshown) with which the main assembly 110 of the image forming apparatus 100 is provided. More concretely, as the body of the waste toner in the toner collection box 1 increases in size large enough to come into contact with the detection window 16, the output signals from the sensor 103 change. Thus, it is based on this change in the output (detection) signals from the sensor 103 that the control section (unshown) determines whether or not the toner collection box 1 is full. However, it may be the toner collection box 1 itself that is provided with a sensor like the sensor 103 in this embodiment.

The lid 20 is roughly in the form of a thin, long, and narrow rectangular parallelepiped, the long edges of which are parallel to the depth direction of the image forming apparatus 100. It has a top wall 21, and four lateral walls 22 (FIG. 5), which slightly protrude vertically downward from the four edges of the top wall 22, in a manner of surrounding the top wall 22. The lid 20 can seal the opening 14 of the main portion 10 by being placed on the main portion 10 so that its lateral walls 22 align with the flanges 13 of the main portion 10, one for one. The portion of the top wall 21 of the lid 20, which is adjacent to the rear edge of the top wall 21, is provided with a toner receiving portion 23, which is roughly cylindrical and extends in the lengthwise direction of the lid 20. The rear end of the toner receiving portion 23, in terms of the lengthwise direction of the lid 20. The rear end of the toner receiving opening 24. The downstream pipe 124 is inserted into the toner receiving portion 23 through the toner receiving opening 24. Thus, waste toner T is made to fall into the toner collection box 1 through the opening 124*b* of the downstream pipe 124, which is in the toner receiving portion 23. Then, it is conveyed further.

The toner conveying screws 30 (which hereafter may be referred to simply as conveying screws) are provided so that as the collected residual toner T falls into the toner collection box 1, the conveying screw 30 conveys the waste toner T in a manner to disperse the toner T in both the lengthwise and widthwise directions of the toner collection box 1 so that the toner collection box 1 is efficiently filled up with the waste toner T. In this embodiment, the toner collection box 1 is provided with three toner conveying screws 30 (30*a*, 30*b* and 30*c*) as described above. Each conveying screw is provided with a rotational shaft 31, and a spiral conveyance rib (spur) 32 fitted around the shaft 31. It can convey the waste toner T in the direction which is intersectional to the gravity direction (roughly horizontally, in this embodiment). In this embodiment, each conveying screw 30 is positioned so that the lengthwise direction of its rotational shaft 31 becomes roughly parallel to the lengthwise direction (that is, depth direction of image forming apparatus 100) of the toner collection box 1, and also, so that it becomes roughly horizontal. Further, each conveying screw 30 is rotatably supported by the lengthwise ends of its rotational shaft 31, as will be described later in detail. It is rotationally driven by the driving force transmitted thereto from a driving motor (unshown), as a driving means, with which the main assembly 110 of the image forming apparatus 100 is provided. This driving force is transmitted to the conveying screw 30 through a driving force receiving portion 33, with which one (rear end, in this embodiment) of the lengthwise ends of the conveying screw 30 is provided. The driving force receiving portion 30 of the conveying screw 30 protrudes outward from the main portion 10. Thus, each conveying screw 30 is enabled to convey the waste toner T in the toner collection box 1 in a manner of leveling the body of the waste toner T in the toner collection box 1. The three conveying screws 30 are positioned in parallel with roughly equal intervals in terms of the widthwise direction of the toner collection box 1. Hereafter, the central conveying screw 30 may be referred to as the first conveying screw 30*a*, and the other two screws positioned in a manner of sandwiching the central conveying screw 30 may be referred to as the second and third conveying screws 30*b* and 30*c*, respectively.

In this embodiment, the lid 20 and main portion 10 of the toner collection box 1 are separable from each other in the vertical direction, that is, the gravity direction. In terms of the sectional view of the toner collection box 1, at a plane perpendicular to the direction of the rotational shaft 31 of the conveying screw 30, the plane S of separation between the lid 20 and main portion 10 is level with, or above, the rotational axis of the conveying screw 30. The plane S of separation between the lid 20 and main portion 10 coincides with a flat plane S which coincides with most of the flange 13 of the main portion 10. It is roughly horizontal. Further, the main portion 10 has the detection window 16, as detecting portion, for detecting whether or not the amount of the waste toner T in the toner collection box 1 has reached a preset value, as described above. Further, the plane S of separation between the lid 20 and main portion 10 is above the detection window 16. This positional arrangement among the above-mentioned portions of the toner collection box 1 makes it possible to prevent the problem that as the lid 20 is separate from the main portion 10 when the toner collection box 1 is full, the waste toner T spills from the main portion 10.

In this embodiment, the toner collection box 1 can be pulled out of the main assembly 110 of the image forming apparatus 100 in the frontward direction (indicated by arrow mark E in FIGS. 2 and 3). As the toner collection box 1 is pulled out of the main assembly 110, the downstream pipe 124 of the toner conveying device 102 comes out of the toner receiving portion 23 of the lid 20 of the toner collection box 1. Further, the toner collection box 1 can be pushed into the main assembly 110 of the image forming apparatus 100 from the front side of the main assembly 110 in the opposite direction from the above described direction in which the toner collection box 1 can be pulled out of the main assembly. As the toner collection box 1 is pushed into the main assembly, the downstream pipe 124 or the toner conveying device 102 enters the toner receiving portion 23 of the lid 20 of the toner collection box 1.

3. Collecting Operation

Next, the operation for transferring the collected residual toner T to the toner collection box 1 to store the collected residual toner T in the toner collection box 1 is described further in detail.

Referring to FIG. 3, the waste toner T is conveyed to the buffer portion 123, by the screw 122*a* in the upstream pipe 122, in the main assembly 110 of the image forming apparatus 100. Then, it is conveyed to the toner collection box 1 by the screw 124*a* in the downstream pipe 124.

Figure 4A:
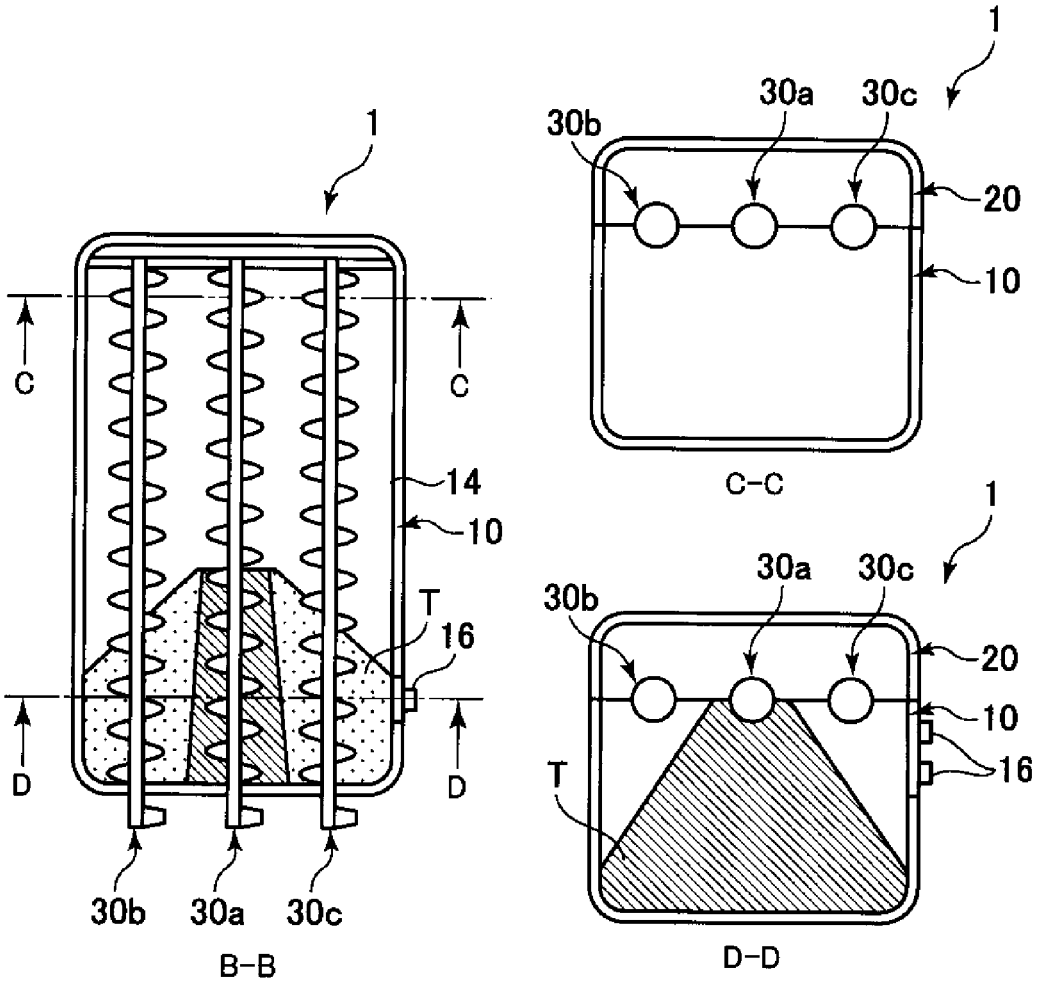
FIG. 4A is a combination of sectional views of the toner collection box in the first embodiment, which is for showing the change in the state of toner accumulation in the toner collection box.
Figure 4B:
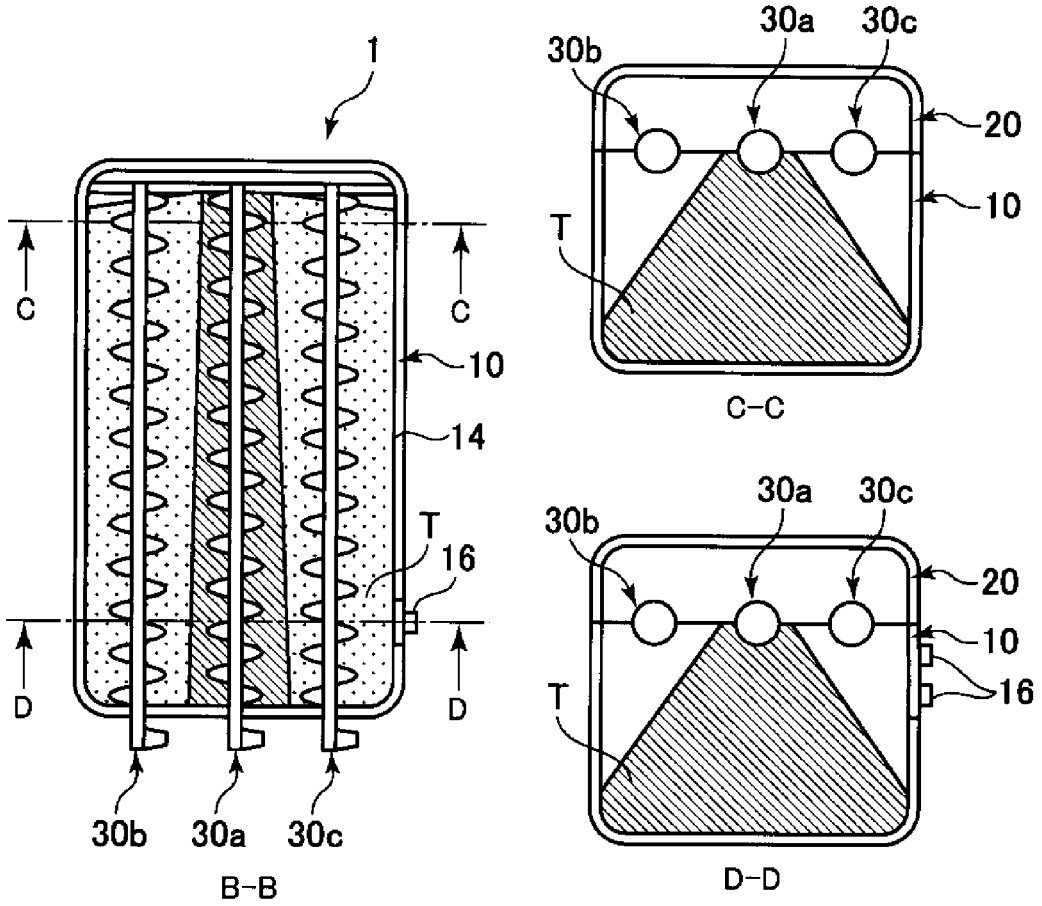
FIG. 4B is a combination of sectional views of the toner collection box in the first embodiment, which is for showing the change in the state of toner accumulation in the toner collection box.

FIGS. 4A-4B schematically show the changes in the state of accumulation of the waste toner T in the toner collection box 1. Each drawing shows the state of accumulation of the waste toner T, at the planes B-B, C-C and D-C in FIG. 3. In each drawing, the area covered with tiny dots represents the surface of the body of waste toner T in the main portion 10, and the hatched area represents the cross-section of the body of waste toner T in the main portion 10.

FIG. 4A shows the state of accumulation of waste toner T in the main portion 10, during the early stage of usage of the toner collection box 1. As for the first conveying screw 30*a*, or the central one, as it is rotationally driven, it conveys the waste toner T from the rear side of the toner collection box 1 toward the front side of the toner collection box 1 in the lengthwise direction of the toner collection box 1 (upward from bottom side of sectional view at plan B-B). As for the second and third conveying screws 30*b* and 30*c*, or the side screws, as they are rotationally driven, they convey the waste toner T from the front side of the toner collection box 1 toward the rear side (downward from top side of sectional view at plane B-B) in the lengthwise direction of the toner collection box 1. Referring to the sectional view at the plane D-D, as the waste toner T accumulates enough in the toner collection box 1 for the body of the waste toner T in the toner collection box 1 to reach the first conveying screw 30*a*, the waste toner T begins to be conveyed frontward (upward from bottom side or sectional view at plane B-B), in the lengthwise direction of the toner collection box 1, by the first conveying screw 30*a*. Therefore, at this stage of accumulation of waste toner T in the toner collection box 1, the body of waste toner T in the main portion 10 does not reach the detection window 16.

FIG. 4B shows the state of accumulation of waste toner T during the mid stage of usage of the toner collection box 1, that is, substantially long time before the toner collection box 1 is filled up with the waste toner T. Referring to the sectional view at the plane C-C, at this stage of accumulation of the waste toner T in the main portion 10, it becomes impossible for the waste toner T in the main portion 10 to be conveyed frontward in the lengthwise direction of the toner collection box 1. Therefore, the waste toner T begins to accumulate in such a manner that the body of waste toner T expand in the widthwise direction (left-right direction in sectional view at plane B-B).

Figure 4C:
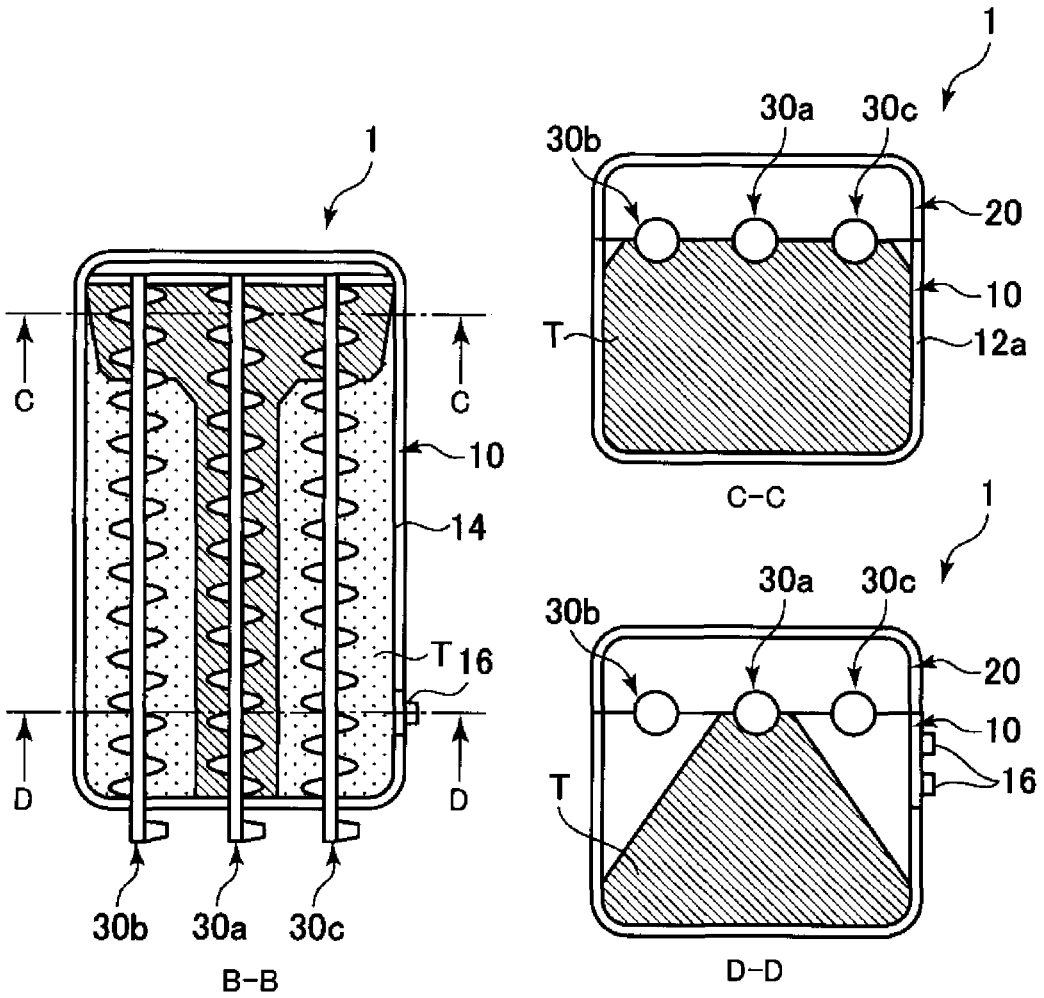
FIG. 4C is a combination of sectional views of the toner collection box in the first embodiment, which is for showing the change in the state of toner accumulation in the toner collection box.

FIG. 4C shows the state of accumulation of the waste toner T in the toner collection box 1, during the latter half of usage of the toner collection box 1, that is, the period in which the toner collection box 1 is filled up. As the waste toner T accumulates enough in the toner collection box 1 for the body of waste toner T in the toner collection box 1 to reach the second and third conveying screws 30*b* and 30*c*, the waste toner T in the toner collection box 1 begins to be conveyed rearward (downward from top side in sectional view at plane B-B) in the lengthwise direction of the toner collection box 1, by the second and third conveying screws 30*b* and 30*c*. Consequently, the waste toner T begins to accumulate in such a manner that the body of waste toner T in the main portion 10 begins to come into contact with the inward surface of the lateral walls 12*a*, which is parallel to the lengthwise direction of the main portion 10.

Figure 4D:
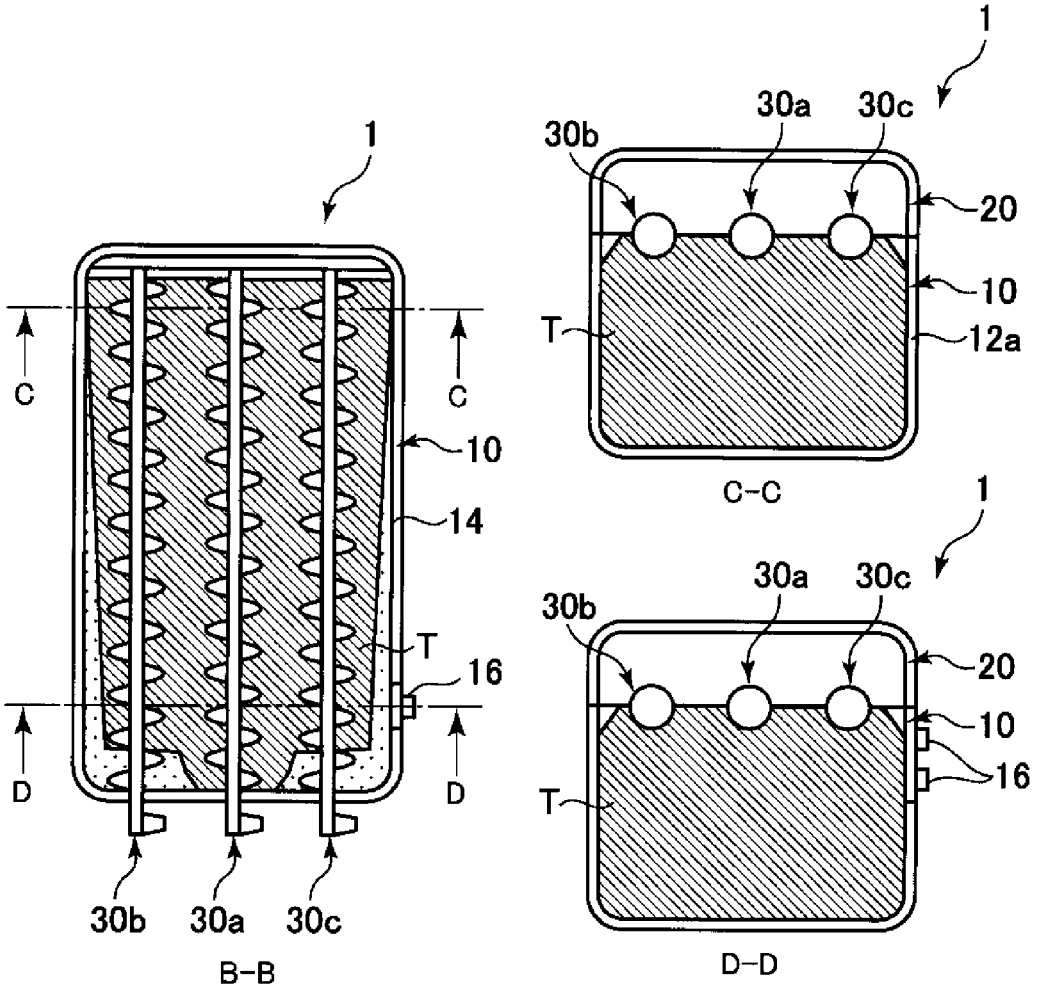
FIG. 4D is a combination of sectional views of the toner collection box in the first embodiment, which is for showing the change in the state of toner accumulation in the toner collection box.

FIG. 4D shows the state of accumulation of the waste toner T in the toner collection box 1, when the toner collection box 1 is full. Once the state of accumulation of the waste toner T in the toner collection box 1 becomes as shown in FIG. 4D, it is impossible for the waste toner T in the toner collection box 1 to be conveyed even rearward in the lengthwise direction of the toner collection box 1. Further, the body of waste toner T in the main portion 10 is in contact with virtually the entirety of inward surfaces of the lateral walls 12 which are parallel to the lengthwise direction (left-right direction in sectional view at plane B-B) of the toner collection box 1. That is, the top surface of the body of waste toner T in the toner collection box 1 has reached the detection window 16. Thus, it is necessary for the toner collection box 1 to be replaced or cleaned.

Conventionally, as the toner collection box 1 becomes full, it is moved out of the main assembly 110 of the image forming apparatus 100, and, is replaced with a brand-new toner collection box 1, or is cleaned to be reused. In a case where the toner collection box 1 was reused, the waste toner in the toner collection box 1 was removed through the toner receiving opening of the toner collection box 1. However, the toner collection boxes for recent printers which ere substantially more durable than the conventional ones are substantially larger in toner capacity than the conventional ones. In other words, the amount of waste toner in a recent toner collection box is much greater relative to the size of the toner receiving portion of the toner collection box. Therefore, the recent toner collection boxes require more time to remove the waste toner therefrom than older versions.

In addition, in the case of a toner collection box equipped with a toner conveying screw (toner conveying screws) for improving the box in fill ratio, simply replacing the entirety of the toner collection box 1 significantly adds to the operational cost.

On the other hand, it is possible to structure a toner collection box so that it can be separated into a lid and main portion in order to simplify the operation for removing the waste toner from a toner collection box, and also, to make it possible to clean and reuse the toner collection box. In the case of conventional toner collection boxes, however, even if they were structured as described above, their toner conveying members, remaining covered with waste toner, had to be removed from their main portion. Thus, when an operator was handling the toner conveying screw and/or cleaning it, the operator had to pay extra attention in order not to contaminate the adjacencies of the toner collection box. Further, even in a case where the toner collection box filled with waste toner was replaced with a brand-new toner collection box to eliminate the amount of time and work necessary to reuse the toner collection box removed from the image forming apparatus 100, the operator had t pay extra attention when cleaning, or simply handling, the toner conveying screw covered with waste toner.

4. Holding of Toner Conveying Screw

Next, the structure of the toner collection box 1 in this embodiment which is related to the holding of the toner conveying screw(s) is described further.

In this embodiment, in consideration of the issues described above, the toner collection box 1 is made simple to disassemble and reuse. More concretely, the toner collection box 1 is structured so that as it is separated into the lid 20 and main portion 10, the toner conveying screws 30 remain with the lid 20. That is, it is structured so that as the lid 20 is removed from the main portion 10, all of the three conveying screws 30*a*, 30*b* and 30*c* remain with the lid 20. Therefore, it is possible for an operator to replace or clean the main portion 10 without directly touching the toner conveying screws 30 when replacing or cleaning the main portion 10 covered with waste toner T. Further, the lid 20, and the toner conveying screws 30 removed with the lid 20, can be cleaned as necessary, and be replaced, or reused with the cleaned main portion 10. That is, the toner collection box 1 can be minimized in the number of its replacement components. Further, it can be minimized in the length of time necessary for its maintenance.

For example, a service person can transfer the waste toner T in the main portion 10 of a toner collection box 1 filled up with waste toner T, to another container, clean the main portion 10, and reuse the main portion 10 with the previously removed lid 10 and toner conveying screws 30, or can visit a client, carrying a brand-new or cleaned main portion 10, replace the toner collection box filled up with waste toner T, with the brand-new, or cleaned main portion 10 brought by the service person, and reuse the lid 20 and toner conveying screws 30 which came with the toner collection box to be serviced. As for the removed main portion 10 of the toner collection box 1, which is full of waste toner T, can be brought back to the service station so that it can be discarded, or cleaned for reuse.

Figure 5:
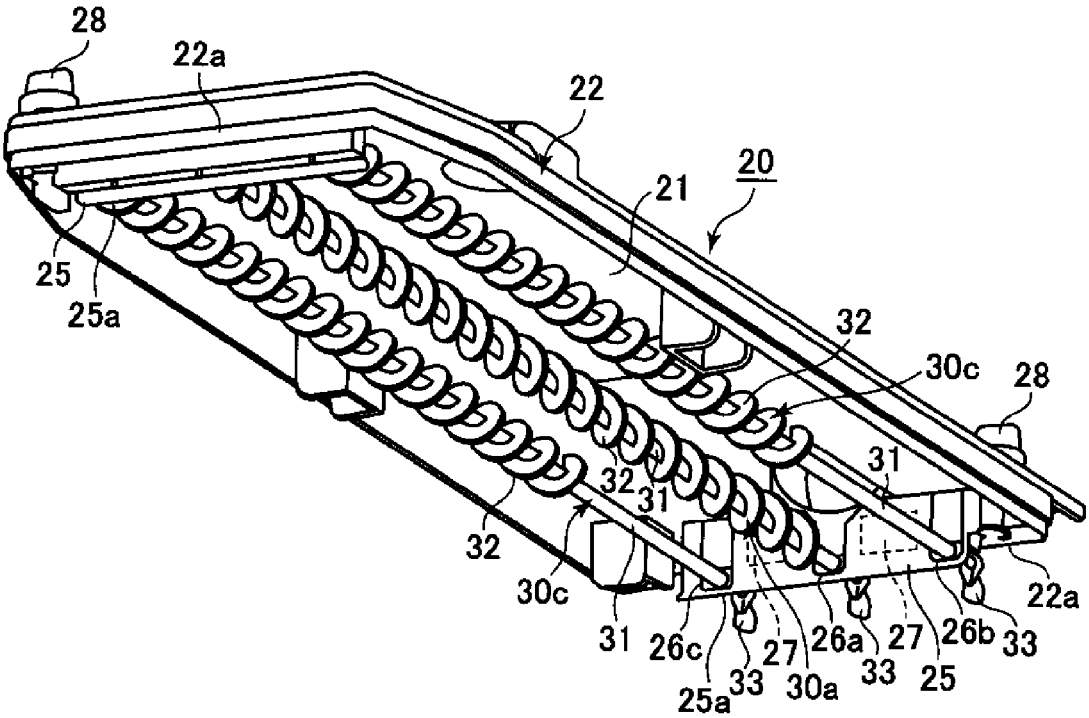
FIG. 5 is a schematic perspective view of the lid portion of the toner collection box in the first embodiment.

FIG. 5 is an external perspective view of the lid 20 of the toner collection box 1 in this embodiment, as seen from below the front-right corner of the lid 20, after the separation of the lid 20 from the main portion 20 of the toner collection box 1. The lid 20 in this embodiment has two holding plates 25 and 25, as holding members, which hold the conveying screws 30 when and after the lid 20 is separated from the main portion 10. The two holding plates 25 and 25 are attached to the lengthwise ends of the lid 20, one for one, and are positioned so that they extend along the inward edges of the ribs 22*a* and 22*a* of the lid 20, which extend in the widthwise direction of the lid 20. Although FIG. 5 shows the structure of only the holding member 25 which is at the lengthwise rear end of the lid 20, the structure of the front holding plate 25 is practically the same as the structure of the rear holding member 25, except that it is symmetrically positioned relative to the rear holding member 25. Each holding member 25 is a long and narrow piece of plate, the lengthwise direction of which is parallel to the widthwise direction of the lid 20. It has three screw holding grooves 26*a*, 26*b* and 26*c*, as screw holding portions, which correspond to the first, second, and third conveying screws 30*a*, 30*b*, and 30*c*, respectively. Each screw holding groove 26 is roughly U-shaped in cross-section, and opens upward.

Each holding plate 25 bears the first, second, and third conveying screws 30*a*, 30*b* and 30*c*, by its screw holding grooves 26 (26*a*, 26*b* and 26*c*, respectively, by the adjacencies of the corresponding lengthwise ends of the rotational shafts 31 of the conveying screws 30*a*, 30*b* and 30*c* one for one. The holding plate 25 is attached to the lid 20 in such a manner that the rotational shaft 31 is sandwiched between itself and the rib 22*a* of the lid 20. Therefore, as the lid 20 is separated from the main portion 10, the conveying screws 30 remain with the lid 20 because they are held to the lid 20 by the holding plates 25 and 25, by their lengthwise end portions.

Because the toner collection box 1 in this embodiment is structured as described above, it is unnecessary for an operator (or service person) to touch the toner conveying screws 30 when the toner collection box 1 needs to be separated into the lid 20 and main portion 10 to replace or clean the main portion 10. Therefore, it becomes easier to maintain the toner collection box 1. Further, it is possible to replace only the main portion 10 of the toner collection box 1, that is, the portion of the toner collection box 1 in which waste toner T has accumulated. Therefore, as the toner collection box 1 in the image forming apparatus 100 is filled up with collected toner T, the lid 20 can be reused by being attached to a brand-new main portion 10. That is, it is unnecessary to cleaning the conveying screws 30, and/or reassemble the lid 20. Therefore, it is possible to minimize the toner collection box 1 (image forming apparatus 100) in the cost of replacement components.

To describe further, in this embodiment, the holding plate 25 is formed of a flexible sheet of synthetic resin. It is pasted to the inward surface of the rib 22*a* of the lid 20 (main portion of lid 20), with the use of a piece of two-aided adhesive tape 27 as fixing means. Incidentally, the means for fixing the holding plate 25 to the lid 20 is optional. For example, the holding plate 25 may be adhered to the lid 20 with use of adhering means other than the piece of two-sided adhesive tape. For example, it may be welded to the lid 20, or structurally attached to the lid 20. The conveying screws 30 are attached to the lid 20, with the presence of a certain amount (2 mm, for example) of play between the wall of the screw holding groove 26 of the holding plate 25, and the rotational shaft 30 of the conveying screw 30.

Figure 6:
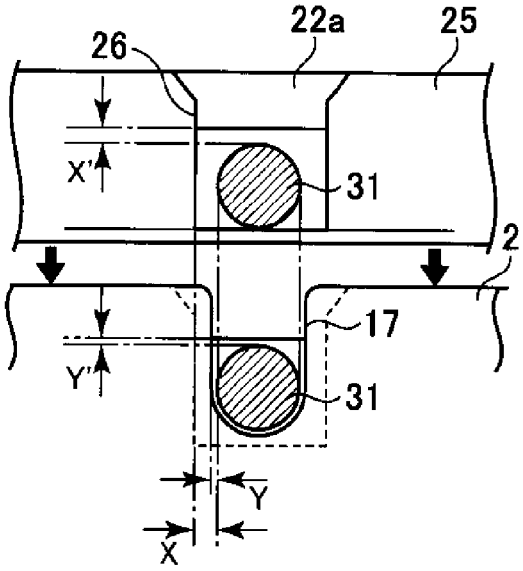
FIG. 6 is a schematic drawing of a combination of the conveying member holding portion and conveying member supporting (bearing) portion of the toner collection box in the first embodiment, which is for describe the relationship between the holding and supporting (bearing) portions.

On the other hand, as the lid 20 is attached to the main portion 10, the conveying screws 30 are supported by the main portion 10. That is, the main portion 10 has supporting portions for supporting the conveying screws 30 after the joining of the lid 20 with the main portion 10. To describe in detail, the ribs 13 of the lateral walls 12*b* and 12*b* of the main portion 10, which are a the front and rear ends of the main portion 10 in terms of the lengthwise direction of the main portion 10 and extend in the widthwise direction of the main portion 10, are provided with bearing portions 17, as conveying screw supporting portions, which are roughly U-shaped in cross-section and open upward. In this embodiment, each of the above described lateral walls 12*b* and 12*b* is provided with three bearing portions 17*a*, 17*b*, and 17*c*, which correspond to the first, second, and third conveying screws 30*a*, 30*b* and 30*c*, respectively. As the lid 20 is joined with the main portion 10, the lengthwise end portion of the rotational shaft 31 of each conveying screw 30, which is supported by the holding plate 25 of the lid 20, settles into the bearing portions 17*a*, 17*b* and 17*c*, respectively, of the main portion 10, and the holding plates 25 and 25 settle on the inward side of the lateral walls 12*b* and 12*b* of the main portion 10. Further, each conveying screw 30 ends up being rotatably supported by the lengthwise end portions of its rotational shaft 31, in such a manner that the lengthwise end portion of the rotational shaft 31 is sandwiched between the bearing portion 17 of the main portion 10, and the rib 22*a* of the lid 20. Although FIG. 2 shows only the structure of the rear bearing portion 17 in terms of the lengthwise direction of the main portion 10, the front bearing portion 17 is practically the same in structure as the rear bearing portion 17, except that it is symmetrically positioned relative to the rear one. The bearing portions 17 of the main portion 10 support the conveying screws 30, with the provision of a smaller amount of play (no more than 0.1 mm, for example) than the conveying screw supporting grooves 26 of the lid 20. That is, referring to FIG. 6, in this embodiment, the plays X between the holding portion (groove) 26 and conveying screw 30, and the play X' between the lid 20 and conveying screw 30 are greater than the play Y between the supporting portion (bearing portion) 17 and conveying screw 30, and the play Y' between the lid 20 and conveying screw 30, respectively, after the attachment of the lid 20 to the main portion 10. Further, the above described X and Y stand for the play in terms of the direction parallel to the plane of the opening 14 of the main portion 10, and the above described X' and Y' stand for the play which are roughly perpendicular to the same plane.

As described above, the position of one each conveying screw 30 is set as the lid 20 is joined with the main portion 10, and the surface, on which the rotational shaft 31 of the conveying screw 30 slides (is borne) when the conveying screw 30 is rotated, is a part of the main portion 10. Therefore, it is possible to reduce the holding plates 25, which are to be reused, in the amount of frictional wear. In other words, it is possible to improve the holding plates 25 in durability.

Also in this embodiment, in order to prevent the problem that when the lid 20 is attached to the main portion 10, the holding plates 25 interfere with the lid 13 of the main portion 10, the bottom portion 25*a* of the holding plate 25 is bent toward the center (inward) of the lid 20 in terms of the lengthwise direction of the lid 20.

Also in this embodiment, a pair of small screws 28 and 28 (FIGS. 2 and 5) which are manually rotatable by an operator are employed as the means for ensuring that the lid 20 remains attached to the main portion 10. Further, the lid 20 is provided with a pair of disengagement preventing members (unshown) which prevent these small screws 28 and 28 from disengaging from the top plate 21 of the lid 20. Not only do the disengagement preventing members prevent the small screws 28 from disengaging from the lid 20, but also, they allow the small screws 28 to be rotationally moved. The disengagement preventing members may be in the form of a protrusion. Further, each disengagement preventing member may be a part of the small screw 28 or lid 20. Therefore, it is possible for an operator (service person) to replace or clean the main portion 10 of the toner collection box 1 without using tools dedicated to the maintenance of the toner collection box 1. Therefore, it is possible to reduce the downtime (period in which image forming apparatus cannot output images). Therefore, the toner collection box 1 in this embodiment can contribute to the reduction in the cost for operating the image forming apparatus 100.

As will be evident from the forgoing description of this embodiment, this embodiment of the present invention can make it easier for an operator (or service person) to replace or clean only the main portion 10 of the toner collection box 1, making it possible to reuse the reusable components of the toner collection box 1 while minimizing the length of time and amount of work necessary to reuse the reusable components. That is, this embodiment can make it easier to replace or clean the main portion 10 of the toner collection box 1; it can make easier such maintenance work as replacing or cleaning the toner collection box 1.

Embodiment 2

Next, another embodiment of the present invention is described. The basic structure and operation of the container for waste developer (developer collection container, hereafter), and those of the image forming apparatus equipped with the developer collection container, are the same as those in the first embodiment. Therefore, the elements of the developer collection container and the image forming apparatus in this embodiment, which are the same in function and structure as the counterparts in the first embodiment are given the same referential codes, one for one, and are not described in detail.

Figure 7:
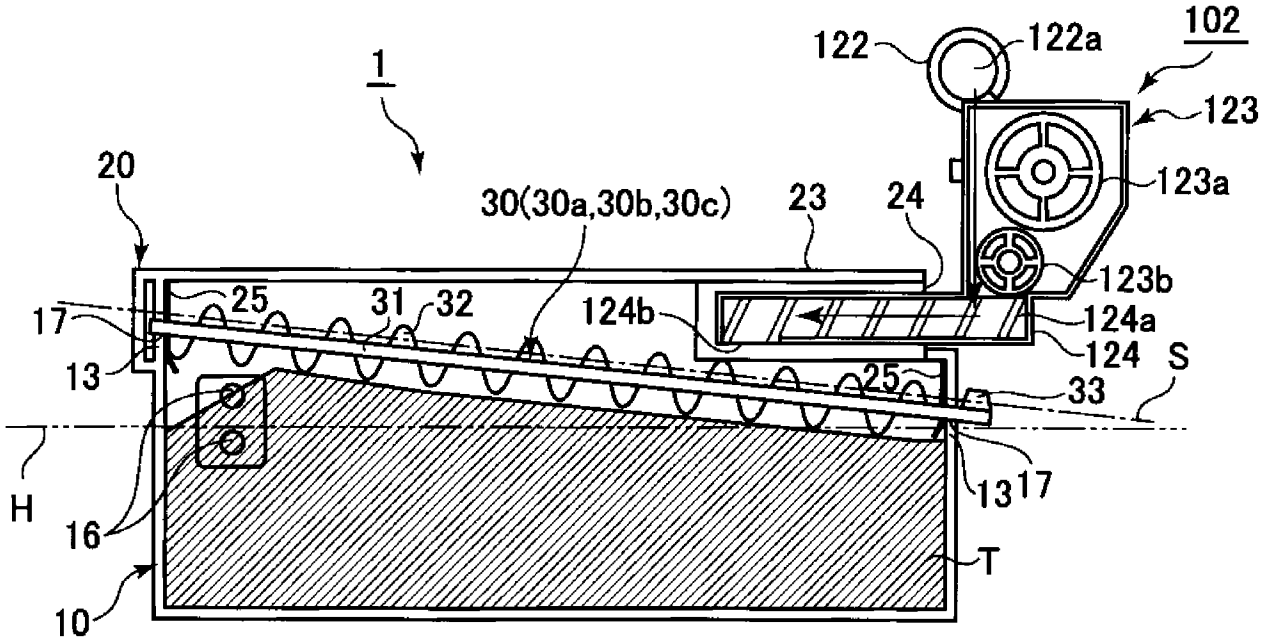
FIG. 7 is a schematic sectional view of the toner collection box in another embodiment of the present invention.

FIG. 7 is a sectional view of the toner collection box 1 in this embodiment, at a plane equivalent to the plane A-A in FIG. 1. In this embodiment, in order to increase the toner collection box 1 in fill ratio, the conveying screws 30 are tilted relative to the horizontal plane (which ordinarily is parallel to surface H on which image forming apparatus 100 is set), in such a manner that, in terms of the lengthwise direction of the toner collection box 1, the front side (left side in FIG. 7) of the conveying screws 30 are positioned higher than the rear side. This structural arrangement makes it possible to more efficiently use the space available in the front portion of the main portion 10 of the toner collection box 1. That is, in comparison to the toner collection box 1 in the first embodiment shown in FIG. 3, the amount by which waste toner T can be stored in the front portion of the main portion 10 of the toner collection box 1 in this embodiment is greater than that in the first embodiment.

In this case, the plane S of separation between the lid 20 and main portion 10 can also be tilted relative to the horizontal plane H as in this embodiment. That is, in this embodiment, the conveying screws 30 are positioned so that their rotational axes are tilted relative to the horizontal plane H. Further, the plane (plane of separation) S which coincides with the plane of division between the lid 20 and main portion 10 is angled relative to the horizontal plane H. Therefore, it is unnecessary to increase in height the toner collection box 1 on the side which coincides with the lower end of the tilted conveying screws 30, in order to prevent the waste toner T from spilling when the lid 20 is separated from the main portion 10.

That is, even in a case where the plane S of separation is angled relative to the horizontal plane, the waste toner T in the toner collection box 1 is conveyed in the direction parallel to the angle of the conveying screws 30. Therefore, the waste toner T is conveyed in such a manner that the top surface of the body of waste toner T in the toner collection box 1 is angled as shown in FIG. 7. Also in this case, the plane S of separation between the lid 20 and main portion 10 is at the same or higher level relative to the plane which is parallel to the widthwise direction of the toner collection box 1 and coincides with the rotational axis of the conveyance screw 30. Further, the plane S of separation is positioned higher than the detection window 16. With this structural arrangement, it is possible to ensure that, even if the lid 20 is separated from the main portion 10 when the toner collection box 1 is full, the waste toner T in the toner collection box 1 does not spill from the main portion 10. Because the angle of the plane S of separation is parallel to the angle of the conveying screw 30, it is possible to ensure without increasing the toner collection box 1 in height that the plane S of separation is positioned higher than the rotational axis of the conveying screw 30 regardless of the position of comparison in terms of the direction of the rotational axis of the conveying screw 30. In other words, this embodiment can make it easier to separate the lid 20 of a toner collection box 1 from the main portion 10 of the toner collection box 1, and replace or clean the main portion 10, even if the conveying screws 30 of the toner collection box 1 are tilted to increase the toner collection box 1 in capacity.

In a case where the convoying screws 30 are tilted as in this embodiment, it is desired that in terms of the direction parallel to the rotational axis of the conveying screw 30, the detection window 16 is located on the side which coincides with the higher end of the rotational axis of the conveying screws 30 relative to the mid point of the rotational axis. In this embodiment, the detection window 16 is located in the adjacencies of the front end of the main portion 10 in terms of the lengthwise direction of the main portion 10, in order to ensure that whether or not the toner collection box 1 is full is detected only when even the highest area of the internal space of the toner collection box 1 is full of waste toner T.

As described above, not only can this embodiment provide the effects similar to those obtainable by the first embodiment, but also, can increase the toner collection box 1 in the ratio of the space which can accommodate waste toner T, relative to the overall size of the toner collection box 1.

Miscellaneous Embodiments

In the foregoing, the present invention was concretely described with reference to a couple of embodiments of the present invention. However, these embodiments are not intended to limit the present invention in scope.

Figure 8:
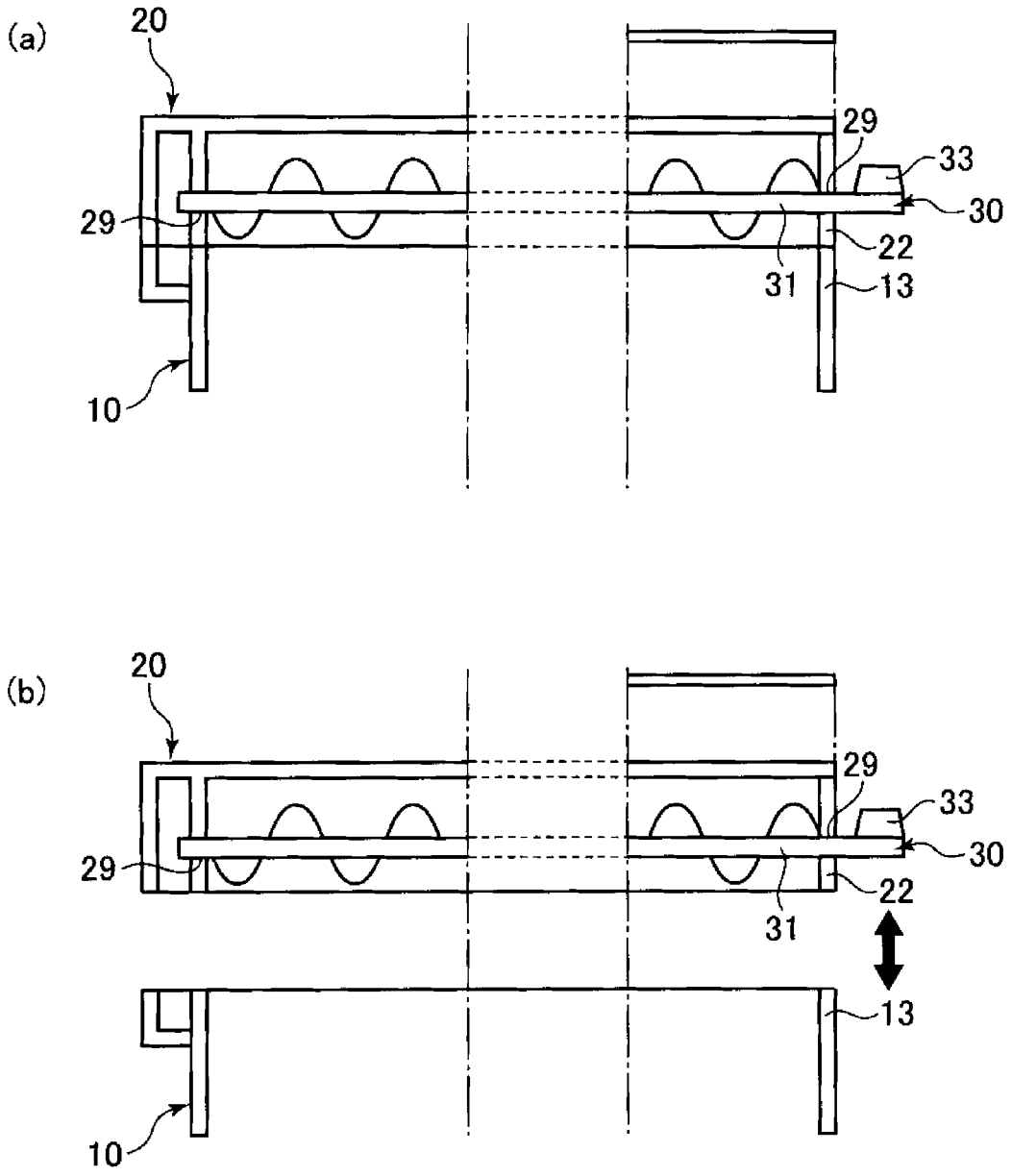
FIG. 8 is a schematic sectional view of the essential portions of the toner collection box in accordance with the present invention, which is for describing a conveying member holding method, which is different from the one in the preceding embodiments.

In the preceding embodiments, the toner collection box 1 is structured so that the lid 20 of the toner collection box 1 was provided with the holding members for holding the toner conveying members after the separation of the lid 20 of the toner collection box 1 from the main portion 10 of the toner collection box 1, and also, so that after the joining of the lid 20 with the main portion 10, the toner conveying members are supported by the main portion 10. This structural arrangement has such effect as reducing the holding members in frictional wear. However, this structural arrangement is not intended to limit the present invention in terms of the structure of the toner collection box 1. For example, referring to FIG. 8, the toner collection box 1 may be structured so that the toner conveying member 30 is supported by a pair of supporting portions 29 and 29 (bearing portions) with which the lid 20 is provided, not only before the lid 20 is separated from the main portion 10, but also, after the separation of the lid 20 from the main portion 10. In such a case, after the separation of the lid 20 from the main portion 10, the conveying member 30 is supported by the lid 20 with the presence of the abovementioned pair of supporting portions 29 and 29 (bearing portions) between the conveying member 30 and lid 20.

Further, the preceding embodiments are not intended to limit the present invention in terms of the components from which the developer (toner) is removed and collected. For example, the present invention is also applicable to an image forming apparatus having means for collecting the developer scattered in the main assembly of the image forming apparatus (for example, device for collecting scattered developer, by electrostatically or magnetically attracting developer). In such a case, the material to be stored in the developer collection box is the developer collected by such means.

Further, the developer to be collected is not limited to toner. For example, in the case of a developing apparatus (device) which uses two-component developer, that is, mixture of toner and carrier, not only is it supplied with toner, but also it is supplied with carrier to gradually replace the carrier in the device with fresh supply of carrier (toner and/developer is trickled into developing device). In such a case, the material collected may be the toner, carrier, or mixture of toner and carrier, from the developing device.

Also in the preceding embodiments, the toner collection box 1 was structured so that all of the multiple conveying members are held to the lid 20 of the toner collection box 1, and are separated from the main portion of the toner collection box 1 together with the lid 20, in order to make it as easy as possible to replace or clean the main portion 10 of the toner collection box 1. However, in a case where the toner collection box 1 is provided with multiple conveying members, it may be structured so that at least one of the conveying members is held by the lid 20 of toner collection box 1 so that at least one of the conveying members is separated from the main portion 10 of the toner collection box 1. Such a structural arrangement can also provide an effect which is more or less similar to those obtainable by the preceding embodiments.

The present invention can simplify the operation for replacing or cleaning the main portion of a container for waste developer, and therefore, can simplify an image forming apparatus in such maintenance as replacing or cleaning the container for waste developer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 054386/2013 filed Mar. 15, 2013, which is hereby incorporated by reference.

What is claimed is:

1. A container detachably mountable to an image forming apparatus for accommodating developer collected from the image forming apparatus, said container comprising:

a case provided with an opening at an upper portion thereof and configured to accommodate the collected developer;

a lid unit that is detachably mounted to said case at a position so as to close said opening, said lid unit being detachable from said case when said case becomes substantially full of collected developer;

a feeding member rotatable about a rotational axis thereof and configured to feed the developer accommodated in said case, said feeding member being supported by said lid unit when said lid unit is dismounted from said case;

a pair of first supporting portions provided on said case correspondingly to respective end portions of said feeding member with respect to a direction of the rotational axis and configured to rotatably support said feeding member by contacting said respective end portions of said feeding member when said lid unit is mounted to said case; and a pair of second supporting portions provided on said lid unit correspondingly to said respective end portions of said feeding member and configured to support said feeding member by contacting said respective end portions of said feeding member when said lid unit is dismounted from said case, wherein said second supporting portions are disposed so as not to contact said respective end portions when said lid unit is mounted to said case.

2. A container according to claim 1, wherein, when said lid is detached from said case, said feeding member and said lid unit are integrally detached from said case.

3. A container according to claim 1, further comprising a second feeding member, wherein a direction in which said first feeding member feeds the developer is opposite to a direction in which said second feeding member feeds the developer.

4. A container according to claim 1, wherein said feeding member includes a rotation shaft and a feeding blade provided around said rotation shaft, and said feeding member is capable of feeding the developer in a direction crossing a direction of gravity.

5. A container according to claim 1, wherein said lid unit and said case are divisible horizontally, and in a cross-section of said feeding member, a position of the division between said lid unit and said case is the same as or above the rotational axis of said feeding member.

6. A container according to claim 5, further comprising:

a detector for detecting that an amount of the collected developer in said case reaches a predetermined level, wherein a position of the division between said lid unit and said case is above a position of said detector.

7. A container according to claim 1, wherein a rotational axis direction of said feeding member is inclined relative to a horizontal plane.

8. A container according to claim 7, wherein a plane of a division between said lid unit and said case is inclined relative to a horizontal plane.

9. A container according to claim 1, wherein said pair of second supporting portions includes a flexible sheet stuck on said lid unit so as to support opposite end portion sides of said feeding member with respect to the rotational axis direction.

10. An image forming apparatus comprising:

an image forming station configured to form an image using developer; and a container detachably mountable to said image forming apparatus, said container being configured to accommodate developer collected from said image forming station, said container comprising:

a case provided with an opening at an upper portion thereof and configured to accommodate the collected developer;

a lid unit that is detachably mounted to said case at a position so as to close said opening, said lid unit being detachable from said case when said case becomes substantially full of collected developer;

a feeding member rotatable about a rotational axis thereof and configured to feed the developer accommodated in said case, said feeding member being supported by said lid unit when said lid unit is dismounted from said case;

a pair of first supporting portions provided on said case correspondingly to respective end portions of said feeding member with respect to a direction of the rotational axis and configured to rotatably support said feeding member by contacting said respective end portions of said feeding member when said lid unit is mounted to said case; and a pair of second supporting portions provided on said lid unit correspondingly to said respective end portions of said feeding member and configured to support said feeding member correspondingly to said respective end portions of said feeding member by contacting said respective end portions of said feeding member when said lid unit is dismounted from said case, wherein said second supporting portions are disposed so as not to contact said end portions when said lid unit is mounted to said case.

11. An image forming apparatus according to claim 10, wherein, when said lid unit is detached from said case, said feeding member and said lid unit are integrally detached from said case.

12. An image forming apparatus according to claim 10, further comprising a second feeding member, wherein a direction in which said first feeding member feeds the developer is opposite to a direction in which said second feeding member feeds the developer.

13. An image forming apparatus according to claim 10, wherein said feeding member includes a rotation shaft and a feeding blade provided around said rotation shaft, and said feeding member is capable of feeding the developer in a direction crossing a direction of gravity.

14. An image forming apparatus according to claim 10, wherein said lid unit and said case are divisible horizontally, and in a cross-section of said feeding member, a position of the division between said lid unit and said case is the same as or above the rotational axis of said feeding member.

15. An image forming apparatus according to claim 10, further comprising:

a detector for detecting that an amount of the collected developer in said case reaches a predetermined level, wherein a position of the division between said lid unit and said case is above a position of said detector.

16. An image forming apparatus according to claim 15, wherein a rotational axis direction of said feeding member is inclined relative to a horizontal plane.

17. An image forming apparatus according to claim 16, wherein a plane of a division between said lid unit and said case is inclined relative to a horizontal plane.

* * * * *